US005672216A

United States Patent [19]

Robic

[11] Patent Number: 5,672,216

[45] Date of Patent: Sep. 30, 1997

[54] DISTORTION FREE HEAT TREATED METAL STAMPINGS

[76] Inventor: John I. Robic, 17 Clydesdale Cir., Brampton, Ontario, Canada, L6Y 3R4

[21] Appl. No.: 322,555

[22] Filed: Oct. 13, 1994

[51] Int. Cl.[6] ..... B32K 31/02

[52] U.S. Cl. ..... 148/527; 148/528; 148/529; 228/190; 228/212

[58] Field of Search ..... 148/527, 528, 148/529, 534; 228/190, 212; 72/337

[56] References Cited

U.S. PATENT DOCUMENTS

| | | | |
|---|---|---|---|
| 1,604,483 | 10/1926 | Roberts | 228/212 |
| 2,438,759 | 3/1948 | Liebowitz | 148/337 |
| 3,866,471 | 2/1975 | Carroll et al. | 72/337 |
| 5,271,142 | 12/1993 | Moore et al. | 29/897.2 |
| 5,448,831 | 9/1995 | Harwood | 29/890.08 |

OTHER PUBLICATIONS

*Metals Handbook*, vol. 6, pp. 887–892, ASM, 1983.

*Primary Examiner*—George Wyszomierski
*Attorney, Agent, or Firm*—Eugene J.A.- Gierczak

[57] ABSTRACT

A method of fabricating sheet metal parts comprising the steps of: stamping a pair of overlying metal sheets together to form a pair of stampings, heat treating the stampings, clamping the stampings together to correct distortion of the stampings during the heat treatment and welding the clamped stampings together to produce the part.

12 Claims, 4 Drawing Sheets

DISTORTION FREE HEAT TREATED METAL STAMPINGS

FIELD OF INVENTION

This invention relates to a method of correcting the distortion of a pair of heat treated sheet metal stampings forming a part and particularly to clamping and welding the heat treated metal stampings together to form the part.

BACKGROUND OF THE INVENTION

It has been known for some time that steel properties can be enhanced by heat treatment. Heat treatment generally improves the mechanical properties of a part by making it harder and stronger. Heat treatment can comprise of heating, quenching and subsequent annealing. Quenching comprises the rapid cooling of steel by emersion in liquids or gases or by contact with metal in order to harden the part. Annealing, on the other hand, comprises a heating and cooling operation employing usually slow cooling. In annealing the treatment of the operation of the rate of cooling depends upon the material being heat treated and the purpose of the treatment.

Metal parts may be made by a variety of processes including metal stamping. Metal stamping is the forming of metal by using a die and a punch that resembles the shape of the part. The metal stamping may be a hot or cold process. During the metal stamping process the part may either be shaped or formed which implies that the metal is bent or it may be punched which implies that the metal is cut as well as being formed.

Accordingly, stamping may be defined as the hot or cold forming of sheet metal by using a die and punch that resembles the shape of the part. The sheet metal is generally the metal of choice in stamping and comprises of metal of any thickness that is the form of a sheet which has one dimension much smaller compared to the other two dimensions. Usually the sheet metal can comprise of a thickness of 0.5 to 3 mm (0.020 to 0.120 inches).

In metal stamping it is generally important to have material that is easily formable. Formability of the part means ease of changing shape. In other words, it is better to have material as soft as possible since it may be easier to stamp.

During the stamping process the sheet metal is formed by using a die and a punch. A die is a tool that forms the part and generally comprises the male shape, while the punch is a tool that also forms the part and generally comprises the female shape.

The concept of forming the part from the soft material first and then once the material is formed heat treating it to improve the strength is very attractive and has been used for many years for low volume production. However, parts that have been formed and then heat treated are severely distorted and show little consistency in shape. Accordingly, the process has not been used in mass production of stampings.

One example of the prior art methods and apparatus can be illustrated by referring to U.S. Pat. No. 5,163,603 which relates to a process of manufacturing hollow triangular upper control arms by stamping a metal body forming an integral portion of the control arm and having a pair of opposing edges, bending the body along two substantially parallel lines and bringing the ends into mutual contact thereby forming a hollow modular section having substantially triangular cross-sectional configuration, welding to permanently join the edges, and piercing a plurality of apertures along the modular section for improving the harmonic resonancy.

Moreover, U.S. Pat. No. 3,068,564 relates to a method of producing laminated metal strips and more particularly to laminating under heat and pressure only.

Yet another method of laminating metal foil and particularly two double sheets of foil which are rolled together in close face-to-face contact and coiled as a single sheet is disclosed in U.S. Pat. No. 2,529,884.

Moreover, U.S. Pat. No. 2,244,847 relates to a method of making structural elements of sheet metal, while U.S. Pat. No. 2,159,043 relates to the making, handling and working of metal members and more particularly to pressure control expedience to be employed during the conditioning, working and handling of such members.

It is an object of this invention to produce sheet metal parts with minimal distortion. More particularly, it is an object of this invention to provide an improved method of fabricating sheet metal parts having little distortion after heat treatment.

The broadest aspect of the invention relates to a method of producing a sheet metal part comprising the steps of: placing a pair of overlying metal sheets in a press and simultaneously forming said metal sheets to a desired shape; heat treating said formed metal sheets so as to increase the mechanical properties of said formed metal sheets and distort said formed metal sheets from said desired shape; clamping said formed heat treated metal sheets together so as to bend said distorted metal sheets back to said desired shape; welding said clamped heat treated metal sheets together to produce said part with said metal sheets with said desired shape.

It is another aspect of this invention to provide a method of fabricating a sheet metal part comprising the steps of: stamping at least a pair of overlying metal sheets simultaneously to form at least a pair of stampings having a desired shape; heat treating said stampings so as to increase the mechanical properties of said stampings, said stampings exhibiting distortion from said desired shape by said heat treatment; clamping said stampings together to bend said distorted heat treated stampings to said desired shape and correct distortion of said stampings; welding said clamped stampings together to control said distortion and to produce said part with said desired shape and increased mechanical properties.

BRIEF DESCRIPTION OF THE DRAWINGS

These and other objects and features will now be described in relation to the following drawings.

DESCRIPTION OF THE INVENTION

Figure 1A:
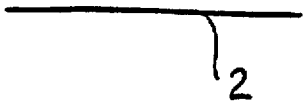
FIGS. 1(*a*), (*b*), (*c*) and (*d*) schematically illustrates a prior existing art stamping process.
Figure 1C:
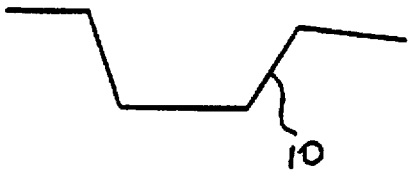
Figure 1B:
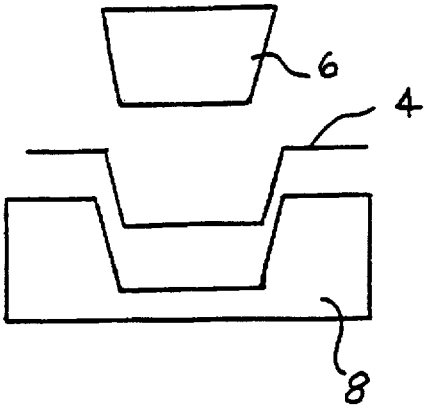
Figure 1D:
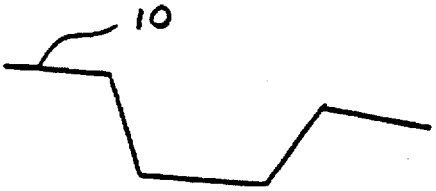
Figure 2A:
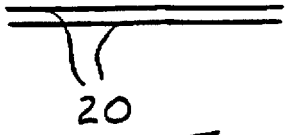
FIGS. 2(*a*), (*b*), (*c*), (*d*) and (*e*) illustrates schematically the twin sheet stamping process of this invention.
Figure 2C:
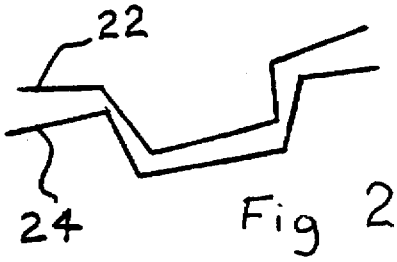
Figure 2B:
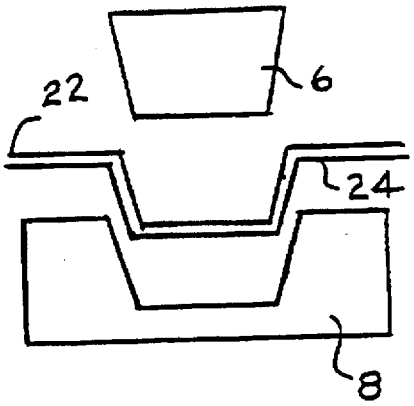
Figure 2E:
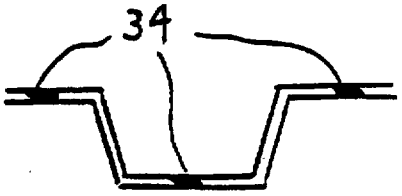
Figure 2D:
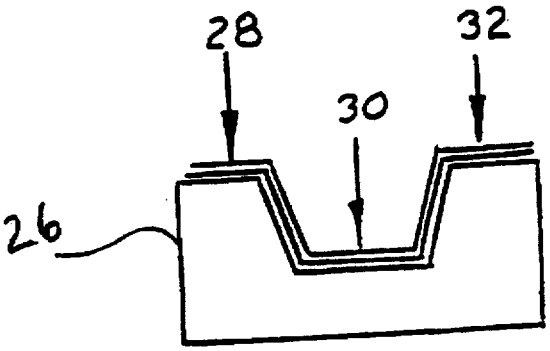
Figure 3:
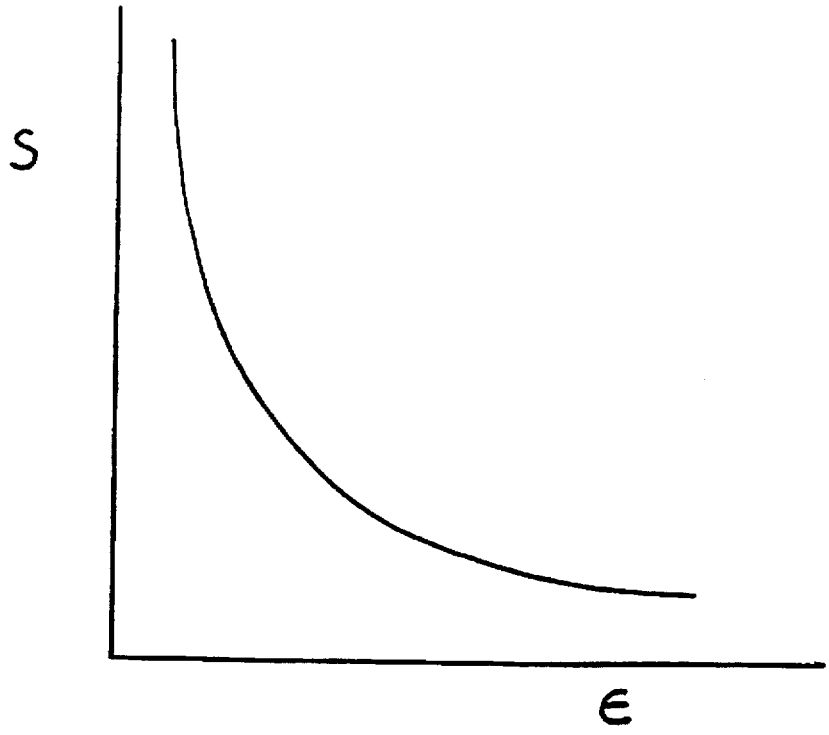
FIG. 3 is a stress to elongation graph.

Like parts shall be given like numbers throughout the figures.

FIGS. 1(*a*), (*b*), (*c*) and (*d*) illustrates the existing stamping process used in the prior art.

The prior art utilizes a single sheet of sheet metal 2 which can comprise of a variety of materials. For purposes of illustration, standard sheet steel can be utilized to form a part such as a bumper which is shown as being formed in cross-section as numeral 4. The single sheet of metal is formed in a standard die 8 and punch 6 to produce a part such as the fender to be utilized on an automobile as illustrated in cross-section as numeral 4.

Any standard sheet metal may be used, but for purposes of producing the bumper illustrated in FIG. 1(*a*), (*b*), (*c*) and (*d*), a standard sheet of steel may be used to produce a stamped part or stamping which would have the strength of approximately 280 N/mm$^2$ (40,000 psi) having an elongation of 20% to 30%. Elongation is a measure of formability of the part and more particularly can be defined as a change in the length of material that the material can withstand without breaking. The measure of elongation is useful when estimating the formability of sheet metal.

Such sheet steel would produce a part which has the strength of 280 N/mm$^2$.

However, in the prior art, in order to harden the sheets of steel, it is heat treated which produces a distortion as best shown by numeral 10. Accordingly, the finished part 10 is distorted and shows no consistency in shape. Accordingly, such process has not been used in mass production stampings.

FIGS. 2(*a*), (*b*), (*c*), (*d*) and (*e*) illustrates a schematic view of the invention described herein which consists of a twin sheet stamping process. In particular, at least two overlying sheets of sheet metal 20 are utilized. In the preferred embodiment, twin sheets 20 are utilized, although it is possible that more than two sheets may be utilized if desired. The twin sheets 20 may be of the same thickness or different thicknesses.

The twin sheets 20 are introduced into a standard die and punch 8 and 6 and bent or formed together. During the stamping process the twin sheets 20 form bent or formed stampings 22 and 24 which will be used to form the finished part 34. In the preferred embodiment, the stampings 22 and 24 are simultaneously formed in the same standard die. By stamping two sheets at the same time, duplication of stamping tools is avoided. However, it is possible that the stampings 22 and 24 may, in another embodiment be stamped in separate stamping tools, although this would increase the cost of forming the part.

Moreover, twin sheets 20 are simultaneously stamped in the preferred embodiment in one standard die 8 and punch 6 so as to produce stampings 22 and 24 which are substantially identical to one another. However, it is possible that one of the stampings 22 and 24 could be smaller or larger than the other, either in length, width, or thickness, and still be in keeping with the invention to be described herein, provided that such stampings have substantially the same configuration.

Once the stampings 22 and 24 are heat treated together they also will distort substantially, and such distortion will be substantially different in the parts.

However, the heat treated stampings 22 and 24 are then clamped in a tool 26 by clamping pressure points 28, 30 and 32 applied at appropriate points so as to bend the distorted heat treated stampings 22 and 24 to the desired shape which is presented by the form 34 as shown in FIG. 2(*e*).

The appropriate clamping pressure is applied so that the stampings 22 and 24 substantially contact one another and then the stampings 22 and 24 are welded in clamped position so as to produce a finished part 34 as shown in FIG. 2(*e*).

The finished part 34 will have appropriate spot welds as shown by FIG. 2(*e*).

Accordingly, the invention is based on the fact that the distortion can be corrected after heat treatment by having two parts welded together in clamped position. Two sheets are clamped together, then heat treated in pairs and welded together in clamped position. By stamping two sheets at the same time, duplication of stamping tools is avoided and it is also possible to achieve greater accuracy and distortion control compared to a process in which two different parts would be welded together to eliminate distortion.

Figure 4:
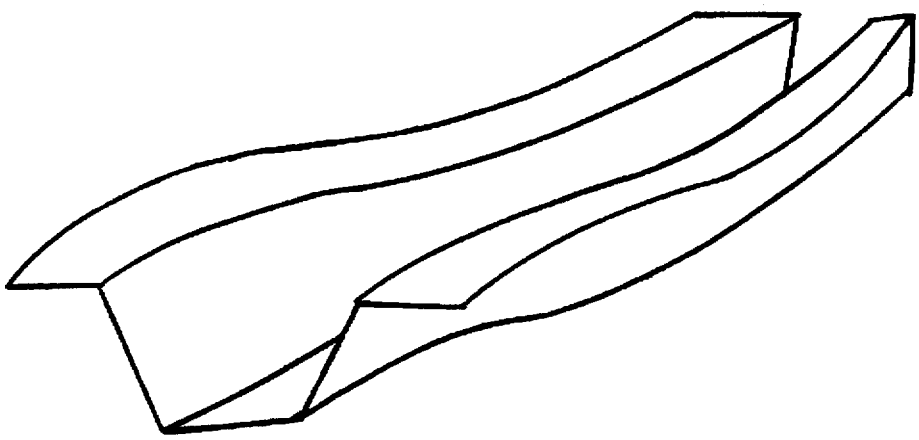
FIG. 4 is a perspective view of an automobile bumper produced by a prior art method.
Figure 5:
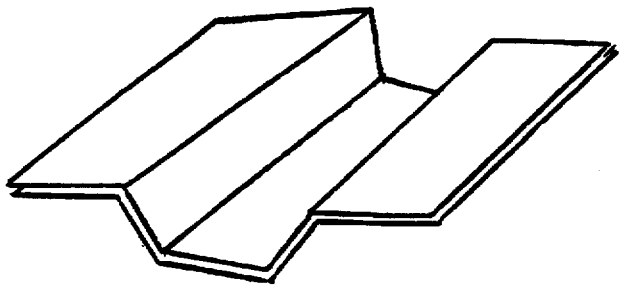
FIG. 5 is a perspective view of an automobile bumper produced by the invention described herein.

During the twin sheet process the material will still have approximately the same formability as in the prior art, for example elongation of *20%*, and strength as comparable with the standard steel of 280 N/mm$^2$ (40,000 psi). After heat treatment and subsequent welding for distortion control, the produced part would have a strength of approximately 1,400 N/mm$^2$ or 200,000 psi. Accordingly, by utilizing the method described herein by utilizing twin sheets one may produce a part which is much stronger, or lighter for the same strength. By utilizing the process, the weight of an automobile car can be reduced by 100 kg, or 220 lbs. For example, if a bumper is produced from sheet steel by the prior an, such bumper, after heat treatment, could have a distortion as illustrated in FIG. 4. By utilizing the twin sheet method described herein to produce a bumper, a bumper which has substantially eliminated the distortion is shown in FIG. 5.

In particular an automobile door may include a reinforcement 50 comprising of a twin sheet of reinforcing members manufactured in accordance with the invention described. Alternatively, a second sheet of sheet metal may be clamped and welded to the body 52 to rigidify and strengthen the door or fender panel as the body panels of many present day cars or other vehicles can be easily dented. By utilizing the inventions herein the body panels of cars can be strengthened.

Figure 6:
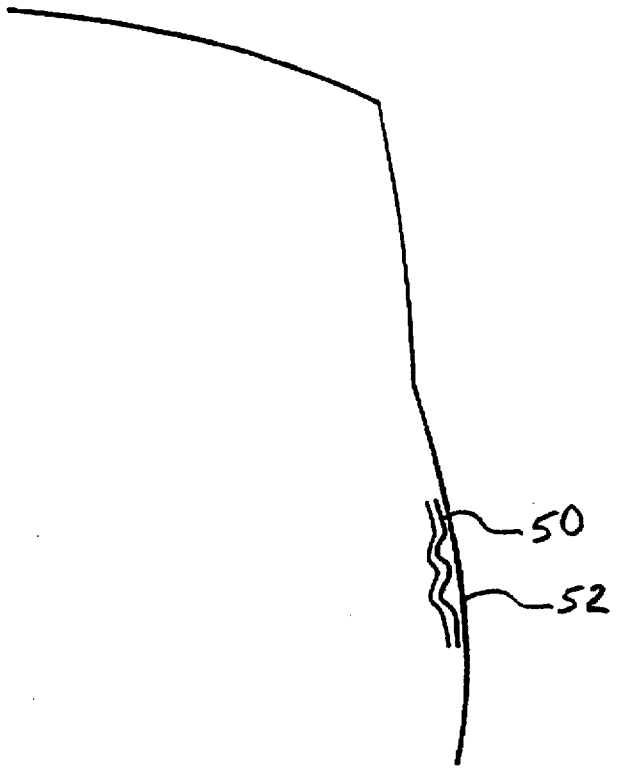
FIG. 6 is a side elevational view of an automobile door beam.

Moreover, the process described herein may provide a designer of automobile bodies much greater flexibility in designing automobile doors as illustrated in FIG. 6. Accordingly, by utilizing the invention described herein, a product which has increased strength may be produced, or for the same strength a part may be made lighter. Accordingly such invention provides a designer with greater flexibility.

Although the preferred embodiment as well as the operation and the use have been specifically described in relation to the drawings, it should be understood the variations in the preferred embodiment could be achieved by a man skilled in the art without departing from the spirit of the invention. Accordingly, the invention should not be understood to be limited to the exact form revealed by the drawings.

The embodiments of the invention in which an exclusive property or privilege is claimed are defined as follows:

1. A method of producing a sheet metal part comprising the steps of:

(a) placing a pair of overlying metal sheets in a press and simultaneously forming said metal sheets to a desired shape;

(b) heat treating said formed metal sheets so as to increase the mechanical properties of said formed metal sheets and distort said formed metal sheets from said desired shape;

(c) clamping said formed heat treated metal sheets together so as to bend said distorted metal sheets back to said desired shape;

welding said clamped heat treated metal sheets together to produce said part with said metal sheets with said desired shape.

2. A method as claimed in claim 1 wherein step (d) comprise simultaneously forming said metal sheets in a stamping press.

3. A method as claimed in claim 2 where step (d) comprises producing an automobile bumper with welded laminated metal sheets.

4. A method as claimed in claim 3 wherein said each said formed metal sheet has a channel shaped cross section and (c) comprises nesting together said formed metal sheets.

5. A method as claimed in claim 2 wherein step (c) comprises clamping said pair of formed heat treated metal sheets in a form.

6. A method of fabricating a sheet metal part comprising the steps of:

(a) stamping at least a pair of overlying metal sheets simultaneously to form at least a pair of stampings having a desired shape;

(b) heat treating said stampings so as to increase the mechanical properties of said stampings, said stampings exhibiting distortion from said desired shape by said heat treatment;

(c) clamping said stamping together to bend said distorted heat treated stampings to said desired shape and correct distortion of said stampings;

(d) welding said clamp stampings together to control said distortion and produce said part with said desired shape and increased mechanical properties.

7. A method as claimed in claim 6 wherein step (d) comprises producing an automobile bumper.

8. A method as claimed in claim 7 wherein step (c) comprises clamping said pair of heat treated stampings in a form.

9. A method as claimed in claim 8 wherein step (d) comprises welding said stampings together to produce a laminated part with said desired shape.

10. A method as claimed in claim 9 wherein said metal sheets comprise steel sheets.

11. A method as claimed in claim 10 wherein each said sheet steel has a strength of approximately 40,000 psi and elongation of approximately 20% to 30%.

12. A method as claimed in claim 11 wherein said heat treated welded stampings have a strength of approximately 200,000 psi.

* * * * *